US005594457A

United States Patent [19]

Wingo

[11] Patent Number: 5,594,457

[45] Date of Patent: Jan. 14, 1997

[54] RETRACTABLE ANTENNA

[75] Inventor: Donald E. Wingo, Lincoln, Nebr.

[73] Assignee: Centurion International, Inc., Lincoln, Nebr.

[21] Appl. No.: 426,815

[22] Filed: Apr. 21, 1995

[51] Int. Cl.[6] ..... H01Q 1/24

[52] U.S. Cl. ..... 343/702; 343/895; 343/900

[58] Field of Search ..... 343/702, 715, 343/895, 900, 901, 906; H01Q 1/24

[56] References Cited

U.S. PATENT DOCUMENTS

| | | | |
|---|---|---|---|
| 4,205,319 | 5/1980 | Gasparaitis et al. | 343/792 |
| 4,760,401 | 7/1988 | Imazeki | 343/702 |
| 4,849,767 | 7/1989 | Naitou | 343/745 |
| 4,867,698 | 9/1989 | Griffiths | 439/317 |
| 5,204,687 | 4/1993 | Elliott et al. | 343/702 |
| 5,300,940 | 4/1994 | Simmons | 343/749 |
| 5,317,325 | 5/1994 | Bottomley | 343/895 |
| 5,353,036 | 10/1994 | Baldry | 343/702 |
| 5,446,469 | 8/1995 | Makino | 343/901 |
| 5,467,096 | 11/1995 | Takamoro et al. | 343/702 |
| 5,469,177 | 11/1995 | Rush et al. | 343/702 |
| 5,479,178 | 12/1995 | Ha | 343/702 |

FOREIGN PATENT DOCUMENTS

| | | | |
|---|---|---|---|
| 3245603 | 11/1991 | Japan . | |
| 6-252621 | 9/1994 | Japan | H01Q 1/24 |

OTHER PUBLICATIONS

Doug Demaw "Lightweight Trap Antennas—Some Thoughts" Jun. 1983.

*Primary Examiner*—Donald T. Hajec
*Assistant Examiner*—Tan Ho
*Attorney, Agent, or Firm*—Zarley, McKee, Thomte, Voorhees & Sease; Dennis L. Thomte

[57] ABSTRACT

A retractable antenna for use with portable communication equipment comprising two electrically independent electromagnetic radiators in a single package with two modes of operation, retracted and extended. When the antenna is in its retracted position, a short normal-mode monofilar helical radiator is functional. When the antenna is in its extended position, a thin linear radiating element is functional. A switch is provided which connects the internal circuitry of the device to the linear radiating element when the antenna is in its extended position and which connects the internal circuitry of the device to the helical radiator when the antenna is in its retracted position. In each of the extended and retracted positions, the linear radiator and the helical radiator are isolated from one another. A modified form of the antenna is also disclosed.

12 Claims, 5 Drawing Sheets

RETRACTABLE ANTENNA

BACKGROUND OF THE INVENTION

1. Field of the Invention

The present invention relates to portable communication equipment that utilize retractable antennas. More particularly, the present invention relatesp 2 More particularly antenna for portable communication equipment that provides performance for the selected mode, retracted or extended, independent of the other mode.

2. Problems in the Art

Generally speaking, there are six related designs commonly used in the field of retractable antennas. Perhaps the simplest design is the fixed length linear whip radiator that has an electrical contact on one end, which makes contact with an electrical connector when the radiator is pulled out of the electronic device. In such a design, retraction of the radiator is accomplished by pushing the whip radiator downwardly from its connection with the connector and into the electronic device.

A further design in the prior art is the telescopic whip that is used for portable consumer products. The telescopic whip generally consists of progressively smaller diameter tubes that fit within the next tube. Such a technique permits the antenna to be collapsed or retracted to a length only slightly longer than the largest diameter tube.

U.S. Pat. No. 4,868,576 discloses a third type of design that consists of a linear whip radiator that is air-coupled to a monofilar helical matching device in the extended position. In the retracted mode, the monofilar matching helical device is used as the electromagnetic radiator.

U.S. Pat. No. 5,204,687 discloses yet another type of retractable antenna. U.S. Pat. No. 5,204,687 describes the retractable antenna as being a ¼ wavelength retractable antenna that consists of a thin linear radiator having an isolated, short monofilar helical radiator on the end thereof. In the extended mode of operation, the thin linear radiator functions as a whip radiator having approximately a ¼ wavelength electrical length. The helical radiator section is positioned on the upper end of the linear radiator and is isolated therefrom by a short section of dielectric preventing the helical radiator from being in the electrical circuit when the antenna is extended. When the antenna is in the retracted mode, the helical radiator is in the electrical circuit due to the retraction of the linear radiator into the electronic device with the helical radiator's electrical connection being made by a short metal tube below the helical radiator.

Yet another type of retractable antenna is that manufactured by Centurion International that consists of a ½ wavelength thin linear radiator with a short monofilar helical radiator connected to the end thereof. In either mode of operation, retracted and extended, the entire antenna package is in the electrical circuit.

SUMMARY OF THE INVENTION

A retractable antenna for a portable communication device such a cellular telephone, two-way radio, etc., is provided which offers maximum performance in the selected mode of operation, retracted or extended, independent of the other mode. Further, a seamless connection between modes is provided by a switching mechanism so that an electromagnetic radiator is always in-circuit during the transition between modes. More particularly, the retractable antenna is adapted to be mounted on a portable communication device including a housing having a receptacle at the upper end thereof which is RF coupled to the circuitry of the device. The antenna includes a first metal connector element for RF connection to the receptacle and has an elongated bore extending between the upper and lower ends thereof. The lower end of an elongated, hollow housing is secured to the first metal connector and extends upwardly therefrom. The housing is comprised of a dielectric material and has an opening formed in the upper end thereof. A helical radiating element is positioned in the dielectric housing as is a normally open electrical switch. The electrical switch, when in its closed position, electrically connects the first metal connector element and the helical radiating element. An elongated radiator is also provided and has a second metal connector element secured to the lower end thereof. A dielectric body member encloses the elongated radiator above the second metal connector and has an upper end portion which extends upwardly beyond the upper end of the elongated radiator. The dielectric body member slidably extends through the opening in the upper end of the housing. The elongated bore in the first metal connector element slidably receives the second metal connector element and the dielectric body. The elongated radiator is movable, with respect to the housing and the receptacle therein, from a retracted position to an extended position. The second metal connector element is in electrical contact with the receptacle when the elongated radiator is in its extended position. The switch is in its normally open position when the elongated radiator is in its extended position so that the helical radiator is inoperative when the elongated radiator is in its extended position. The upper end portion of the dielectric body member is positioned within the helical radiator when the elongated radiator is in its retracted position to isolate the elongated radiator from the helical radiator. A switch actuator is associated with the elongated radiator for positioning the switch in its closed position when the elongated radiator is moved downwardly from its extended position towards its retracted position.

In an alternative embodiment, a metal sliding contact which is in the form of a collar is mounted on the dielectric body member below the upper end thereof. When the antenna is in its retracted position, the metal collar is in electrical contact with a lower contact, which is in contact with the housing receptacle and the helical radiating element. When the antenna is in its extended position, the lower contact is in electrical contact with the metal connector positioned on the lower end of the elongated radiator.

A principal object of the invention is to provide a retractable antenna which provides performance for the selected mode, retracted or extended, independent of the other mode.

A further object of the invention is to provide a retractable antenna designed so that maximum performance of the antenna is provided in the selected mode of operation.

Another object of the invention is to provide a retractable antenna having a seamless connection provided by a switching mechanism so that an electromagnetic radiator is always in-circuit during the transition between modes.

Yet another object of the invention is to provide a retractable antenna which provides electrical performance equivalent to the performance obtained with independent antennas in a single mechanical package.

Yet another object of the invention is to provide a retractable antenna wherein electromagnetic radiators therein are electrically isolated from one another when the antenna is in its retracted position and when the antenna is in its extended position.

DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalents which may be included within the spirit and scope of the invention. In its preferred embodiment, the present invention applies to a conventional cellular telephone transceiver. Since the present invention applies to both radio receivers and transmitters, for purposes of this application, the term "transceiver" will be deemed to include a receiver, a transmitter, or a combination of the two unless otherwise specified. Further, for the purposes of this application, the terms "portable communication equipment" or "portable communication device" shall be deemed to include a cellular telephone, two-way radio, a receiver, or a transmitter.

Figure 1:
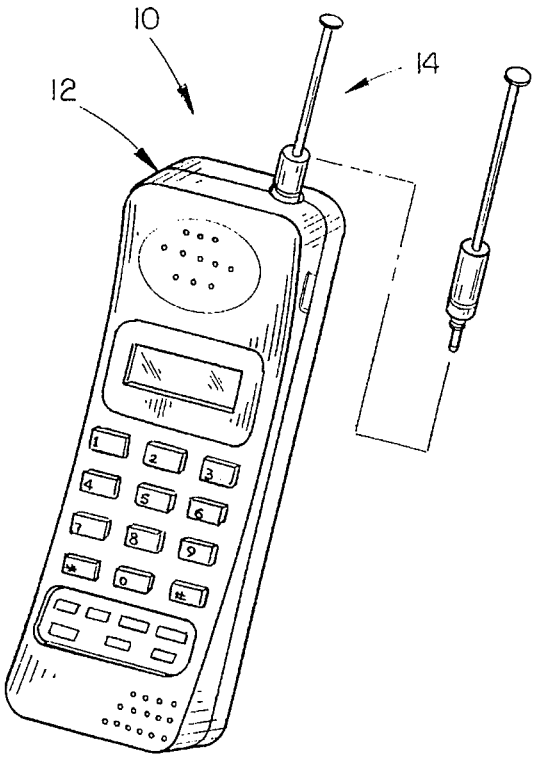
FIG. 1 is a perspective view illustrating a cellular telephone and an antenna.
Figure 2:
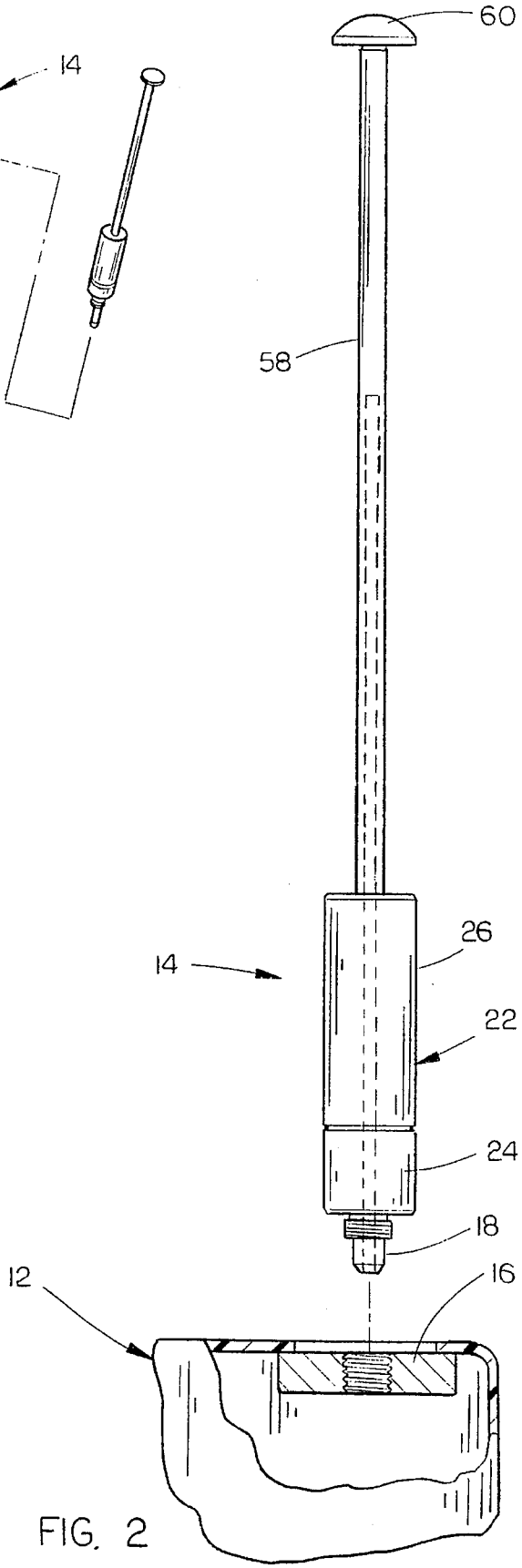
FIG. 2 is an exploded perspective view of the antenna of the present invention.

In FIG. 1, the numeral 10 refers to a cellular telephone having a housing 12 and an antenna 14. The antenna 14 is electrically connected to the internal circuitry of the telephone 10 through a connector element 16 as will be described in more detail hereinafter.

Figure 3:
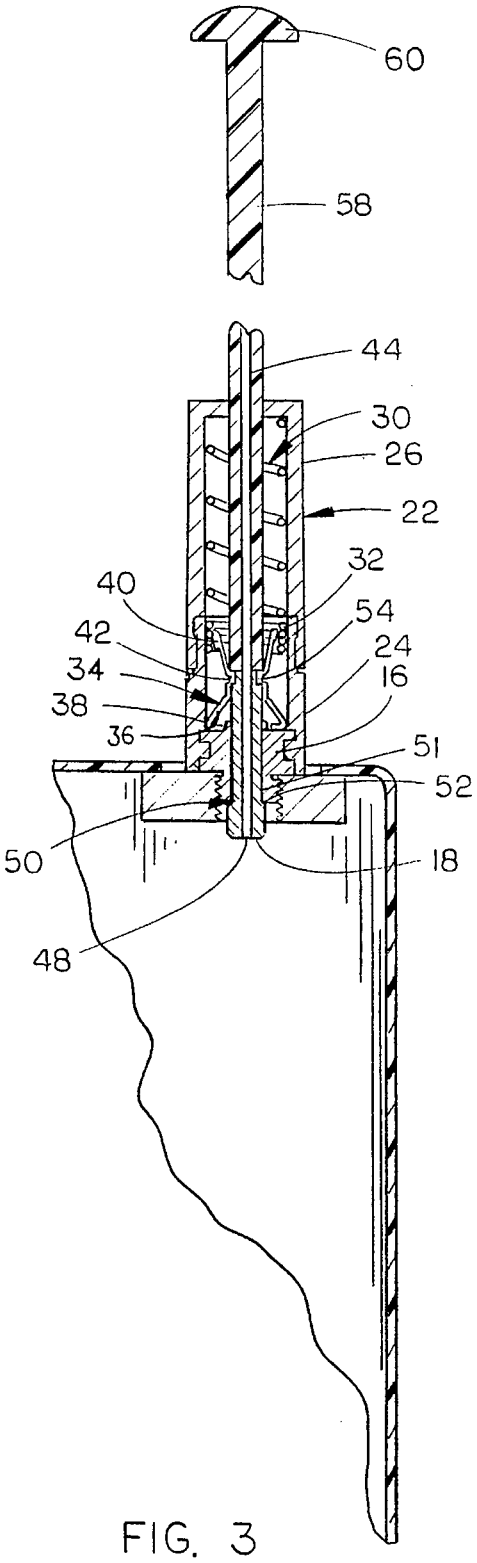
FIG. 3 is a sectional view of the retractable antenna in the extended position.
Figure 4:
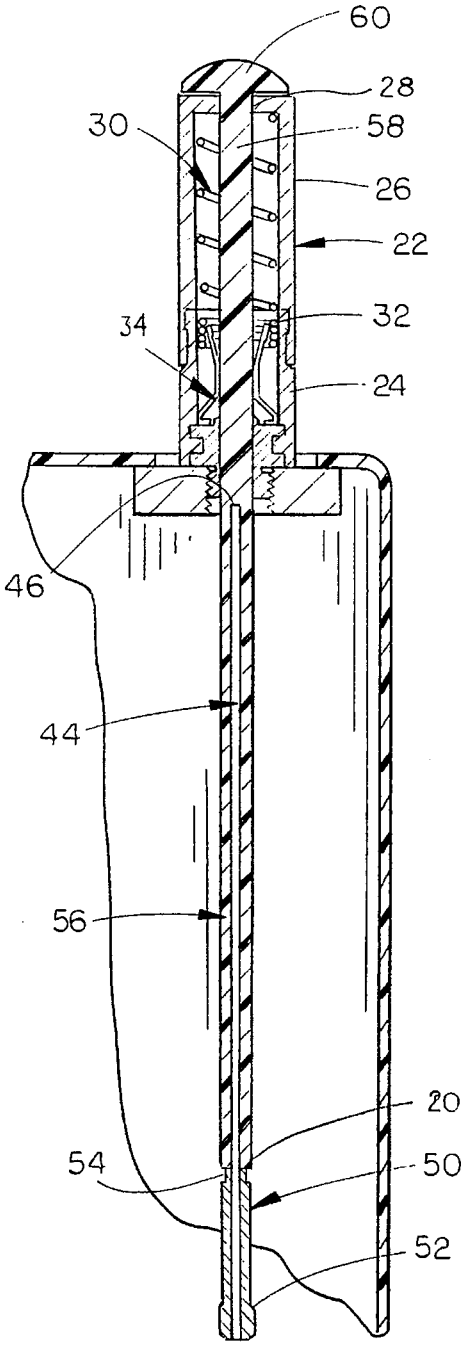
FIG. 4 is a sectional view of the retractable antenna in the retracted position.

Antenna 14 includes a first metal connector element 50 for RF connection to the connector element 16 in conventional fashion. For purposes of description, connector element 50 will be described as having a lower end 18 and an upper end 20. The numeral 22 refers to an elongated, hollow housing comprised of a suitable dielectric material. As seen in the drawings, housing 22 is comprised of a lower end portion 24 and an upper end portion 26 which are joined together. However, housing 22 could be comprised of a single piece member if so desired. The lower end of lower end portion 24 of housing 22 embraces and is secured to connector 16 as illustrated in FIGS. 3 and 4. The upper end of upper end portion 26 of housing 22 has an opening 28 formed therein as will be described in more detail hereinafter.

A helical radiating element 30 is mounted in the interior of housing 22 and is preferably provided with a contact element electrically connected to the lower interior thereof as seen in the drawings and which is referred to generally by the reference numeral 32.

A normally open electrical switch 34, preferably comprised of beryllium copper, is mounted in the housing 22 and has its lower end in electrical contact with the connector element 16 as seen in FIG. 3. Switch 34 preferably includes a plurality of flexible finger elements 36 which extend upwardly from the lower end thereof. Preferably, each of the fingers 36 includes a lower end portion 38 and an upper end portion 40 having an annular detent portion 42 positioned therebetween. When switch 34 is in its normally open position, upper end portions 40 of the fingers 36 do not electrically engage the electrical contact 32. However, when switch 34 is moved to its closed position, as will be described in more detail hereinafter, the upper end portions 40 of the fingers 36 electrically engage the contact 32.

The numeral 44 refers generally to an elongated radiator, preferably comprised of nickel-titanium, having an upper end 46 and a lower end 48. The metal connector element 50 is electrically connected to the lower end of the elongated radiator 44 as seen in the drawings. Connector element 50 may be slidably received in the elongated bore 51 formed in connector element 16 and has a stop 52 formed therein which engages the lower end of connector element 16 when the elongated radiator 44 is in the extended position (FIG. 3). When the elongated radiator 44 is in its extended position, as seen in FIG. 3, the connector element 50 is RF coupled to the connector element 16. The upper end of connector element 50 is provided with a recess portion 54 formed therein which is adapted to receive the detent portions 42 of the fingers 36, when the antenna is in its fully extended position, as illustrated in FIG. 3. A dielectric body member 56 embraces radiator 44 above connector element 50 as seen in the drawings and has an upper end portion 58 which extends beyond the upper end 46 of the radiator 44. The upper end of the upper end portion 58 is provided with an enlarged head portion 60 which is provided to limit the inward movement of the antenna with respect to the housing 22 (FIG. 4).

When the antenna is in its retracted position, as illustrated in FIG. 4, the enlarged head portion 60 of the dielectric body member 56 is positioned adjacent the upper end of the housing 22. When the antenna is in its retracted position (FIG. 4), the elongated radiator 44 is positioned below the helical radiator 30. As also seen in FIG. 4, the upper end portion 58 of body member 56 is positioned within the helical radiator 30, when the antenna is in its retracted position, so that there will be no electrical interference between the elongated radiator 44 and the helical radiator 30.

When the antenna is in its retracted position, as illustrated in FIG. 4, the engagement of the detent portions 42 of the fingers 36 with the dielectric body member 56 causes the fingers 36 to be moved outwardly so that the upper ends of the fingers 36 electrically engage the contact 32 so that the helical radiator 30 is RF coupled to the circuitry of the telephone. When the antenna is in its retracted position, the elongated radiator 44 is not RF coupled to the telephone circuitry so that the helical radiator 30 functions independently of the elongated radiator 44. The opening of switch 34 is caused by detent portions 42 being received by the recess portions 54 of connector element 50.

When it is desired to move the antenna from its retracted position to its extended position, the operator grasps the enlarged head section 60 and pulls the antenna upwardly with respect to the telephone. During the upward movement of the antenna to its extended position, the helical radiator 30 remains functional and does remain functional until the detent portions 42 "snap in" the recess portions 54, at which time the switch 34 opens. At the same time, the elongated radiator 44 is RF coupled to the telephone circuitry by means of the electrical connection between connector 50 and connector 18. Electrical connection between the telephone circuitry and elongated radiator 44 is achieved, when the antenna is in its fully extended position, by the electrical contact between the fingers 36 and the connector element 50. Electrical connection between the telephone circuitry and radiator 44 is also achieved, when the antenna is in its fully extended position, by the electrical contact between connector element 50 and connector element 16. Thus, when the antenna is in its fully extended position, the elongated radiator 44 is functional and the helical radiator 30 is non-functional.

A unique feature is also provided in that the engagement of the lower exterior portion of the dielectric body member 56 and the detent portions 42 causes the upper ends of the fingers 36 to electrically contact the contact 32 of helical radiator 30 as soon as the antenna is moved from its fully extended position so that there is no intermittent or partial contact that occurs during extension or retraction so that the circuit has a very positive make/break design. The positive make/break design of the antenna minimizes dropped calls because of the positive switch action. This is achieved, as previously stated, since one of the radiators is always in operation without any gap between the switching during the retraction or extension operation of the antenna.

Thus it can be seen that a unique retractable antenna has been provided which provides maximum performance in the selected mode of operation. It can also be seen that a unique switching mechanism has been provided which provides a seamless connection between the modes so that an electromagnetic radiator is always in-circuit during the transition between modes.

It should be noted that the antenna is ideally suited for use with cellular telephones, although the antenna may be used with other portable communication devices such as two-way radios, receivers, transmitters, etc.

Figure 5:
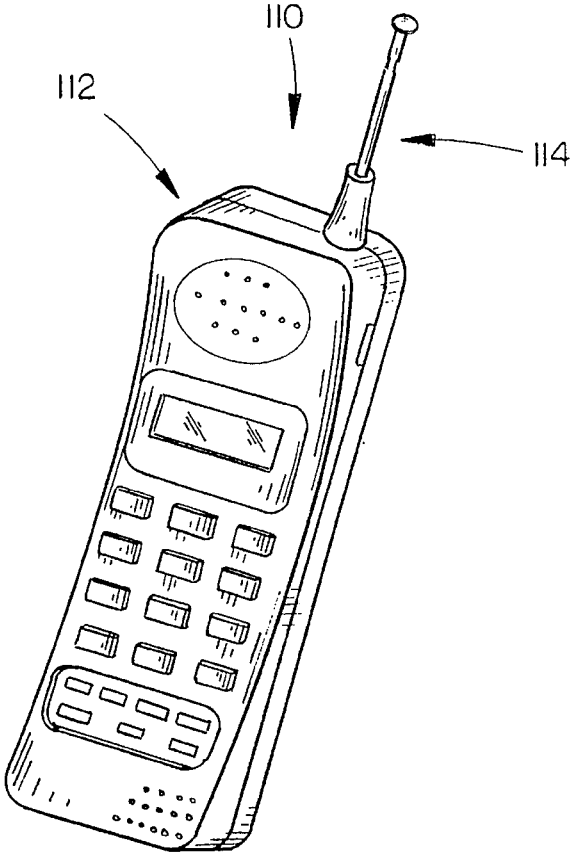
FIG. 5 is a perspective view illustrating a cellular telephone having a modified form of the antenna provided thereon.
Figure 6:
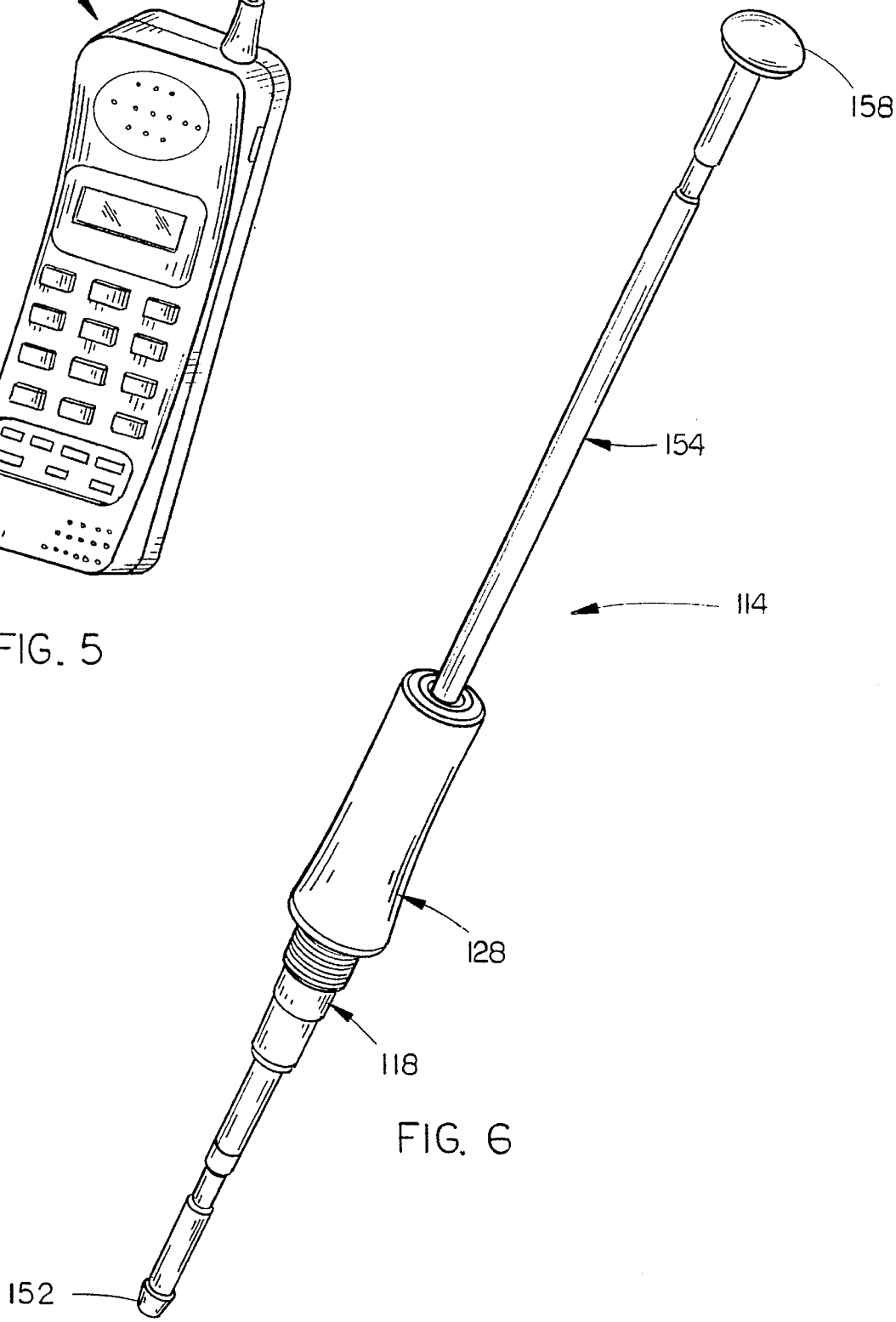
FIG. 6 is a perspective view of the modified antenna of FIG. 5.
Figure 7:
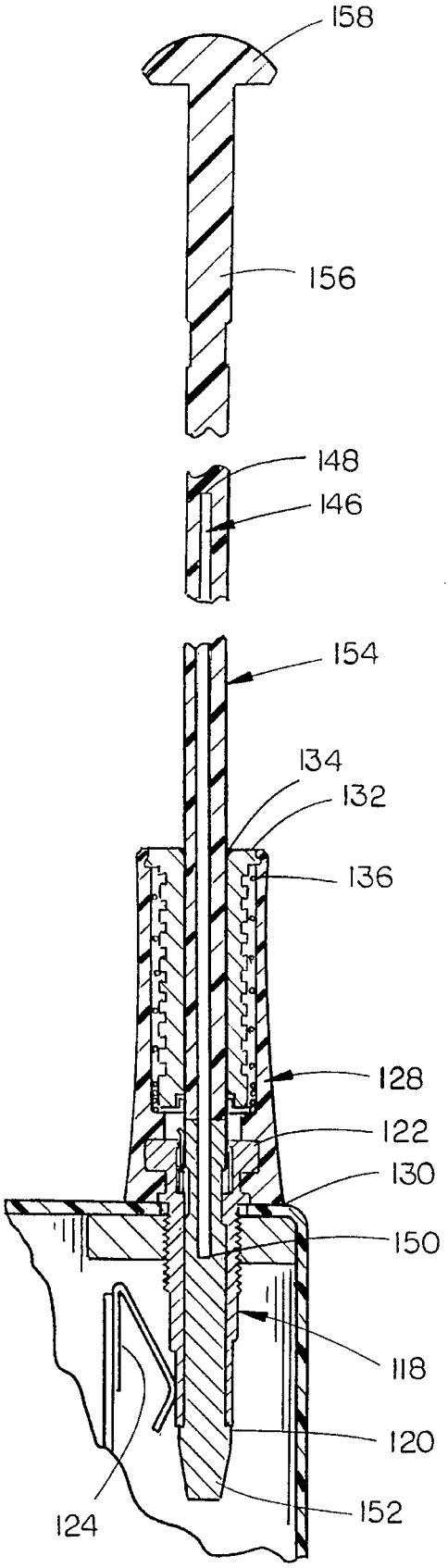
FIG. 7 is a longitudinal sectional view of the antenna of FIGS. 5–6 in an extended position.
Figure 8:
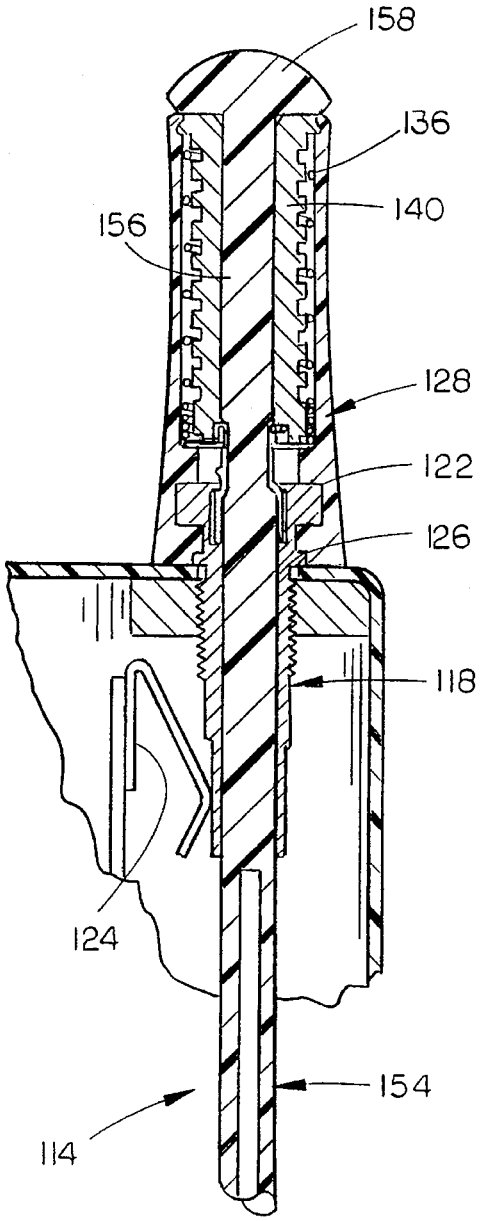
FIG. 8 is a longitudinal sectional view of the antenna of FIGS. 5–7 in a retracted position.

FIGS. 5–8 illustrate a modified form of the antenna. In FIG. 5, the numeral 110 refers to a cellular telephone having a housing 112 and an antenna 114. The antenna 114 is electrically connected to the internal circuitry of the telephone through board contact 124. Antenna 114 includes a first metal connector element 118 adapted to be threadably mounted in the upper end of the housing 112 as illustrated in FIGS. 7 and 8. For purposes of description, connector element 118 will be described as having a lower end 120 and an upper end 122. Connector element 118 is RF connected to the circuitry within the cellular telephone by means of the board contact 124. Connector element 118 includes an elongated bore 126 extending therethrough.

The numeral 128 refers to an elongated housing comprised of a suitable dielectric material. As seen in the drawings, housing 128 includes a lower end 130 and an upper end 132. The lower end of housing 128 embraces and is secured to the upper end of connector element 118 as illustrated in FIGS. 7 and 8. The upper end of housing 128 has an opening 134 formed therein as will be described in more detail hereinafter.

A helical radiating element 136 is mounted in the interior of housing 128 and has its lower end in electrical contact with an upper contact 138 including an arcuate contact finger 139. The helical radiating element 136 is mounted on a coil form 140 as illustrated in FIGS. 7 and 8. The numeral 142 refers to a lower contact positioned within housing 128 and including an arcuate contact finger 144.

Figure 9:
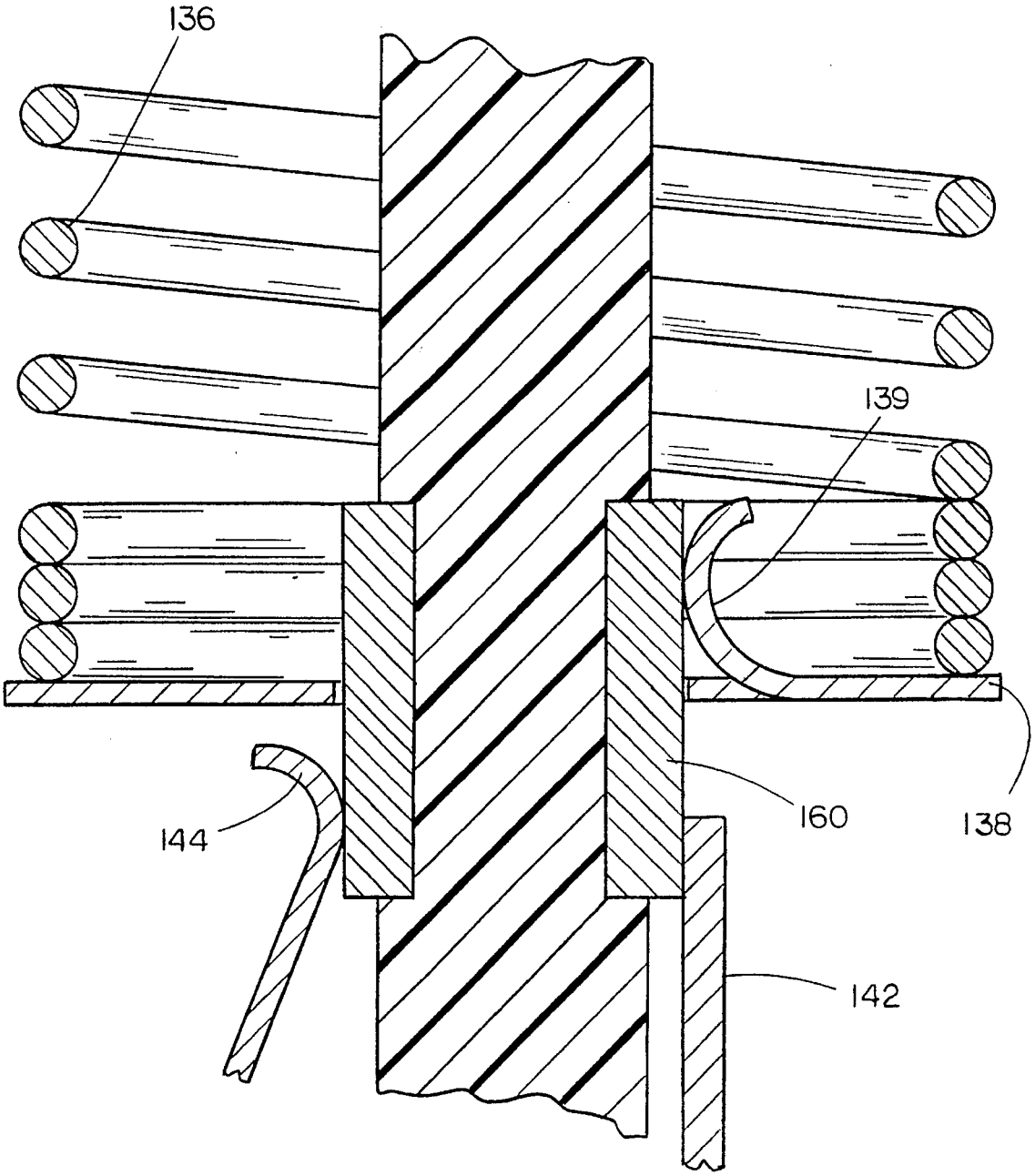
FIG. 9 is an enlarged partial sectional view of the antenna in its retracted position.

The numeral 146 refers to an elongated radiator, preferably comprised of nickel-titanium, having an upper end 148 and a lower end 150. A metal connector element 152 is secured to the lower end of radiator 146 as best seen in FIGS. 7 and 8. A dielectric body member 154 embraces radiator 146 above connector element 152 and has an upper end portion 156 which extends above the upper end 148 of the radiator 146. The upper end of the upper end portion 156 is provided with an enlarged head portion 158 which is provided to limit the inward movement of the antenna with respect to the housing 128. As seen in FIG. 9, a metal collar 160 embraces radiator 136 so that the radiator 136 will be in electrical contact with the contact finger 144 when the antenna is in its retracted position, as illustrated in FIG. 9. When the antenna is in the retracted position of FIG. 9, the sliding contact 160 will also be in electrical contact with the contact finger 140.

When the antenna is in the extended position of FIG. 7, only the elongated radiator 146 will be RF coupled to the telephone circuitry. Such RF connector is achieved through the board contact 124, connector element 118, connector element 152 and the radiator 146. When the antenna is in the extended position of FIG. 7, the helical radiator 136 is not in circuit.

When the antenna is moved from the extended position of FIG. 7 to the retracted position of FIGS. 8 and 9, the elongated radiator is not RF coupled to the telephone circuitry; However, in the retracted position, the helical radiator 136 is in electrical contact with the telephone circuitry. Such contact is achieved through the board contact 124, connector element 118, lower contact 142 (contact finger 144), sliding contact 160 and upper contact 138 (contact finger 140). When the helical radiator is in circuit when the antenna is in the retracted position of FIGS. 8 and 9, the upper end,portion 156 of dielectric body member 154 as illustrated in FIG. 8. When the antenna is in the retracted position of FIGS. 8 and 9, the elongated radiator 146 is positioned below the helical radiator 136. As also seen in FIG. 8, the upper end portion 156 of body member 154 is positioned within the helical radiator 136, when the antenna is in its retracted position, so that there will be no electrical interference between the elongated radiator 146 and the helical radiator 136.

Thus it can be seen that a novel telephone antenna has been illustrated in FIGS. 5–9. The embodiment illustrated in FIGS. 5–9 employs a switch that is actuated by sliding a cylindrical metal collar into two separate contacts. The switch of the antenna of FIGS. 5–9 is used to switch RF energy from a straight piece of wire to a helical long piece of wire. Further, the switch of the embodiment of FIGS. 5–9 is totally self-contained internal to the antenna and employs a self-cleaning switch. Thus it can be seen that the embodiment of FIGS. 5–9 achieves all of its stated objectives.

I claim:

1. A retractable antenna for a communication device including a first housing having a receptacle at the upper end thereof which is RF coupled to the circuitry of the communication device comprising:

a first metal connector element for RF connection to said receptacle and having an elongated bore extending therethrough, said first metal connector element having upper and lower ends;

a second housing, said second housing being elongated and hollow and having upper and lower ends;

said lower end of said second housing being secured to said first metal connector element;

said second housing having an opening formed in its upper end;

said second housing being comprised of a dielectric material;

a first helical radiating element in said second housing and having upper and lower ends;

a normally open electrical switch in said second housing and being movable from its normally open position to a closed position;

said switch, when in its said closed position, electrically connecting said first metal connector element and said helical radiating element;

an elongated radiator having upper and lower ends;

a second metal connector element secured to the lower end of said elongated radiator;

a dielectric body member enclosing said elongated radiator above said second metal connector element and having an upper end portion which extends upwardly beyond the upper end of said elongated radiator;

said opening in said upper end of said second housing slidably receiving said dielectric body member;

said elongated bore in said first metal connector element adapted to slidably receive said second metal connector element and said dielectric body member;

said elongated radiator being movable, with respect to said second housing and said receptacle therein, from a retracted position to an extended position;

said second metal connector element being in operative electrical contact with said receptacle when said elongated radiator is in its extended position;

said switch being in its said normally open position, when said elongated radiator is in its said extended position so that said helical radiator is inoperative when said elongated radiator is in its said extended position;

said upper end portion of said dielectric body member being positioned within said helical radiator, to electrically isolate said elongated radiator from said helical radiator when said elongated radiator is in its said retracted position;

and a switch actuator associated with said elongated radiator for positioning said switch in its said closed position when said elongated radiator is moved downwardly from its said extended position towards its said retracted position.

2. The retractable antenna of claim 1 wherein said second metal connector element includes a recessed portion formed therein which receives a portion of said switch to permit said switch to move to its normally open position when said elongated radiator is in its said extended position.

3. The retractable antenna of claim 2 wherein said recessed portion is located at the upper end of said second metal connector element immediately below the lower end of said dielectric body member.

4. The retractable antenna of claim 2 wherein said switch is in electrical contact with said second metal connector element when said elongated radiator is in its said extended position.

5. The retractable antenna of claim 1 wherein said portable communications device comprises a cellular telephone.

6. The retractable antenna of claim 1 wherein said portable communications device comprises a radio transmitter.

7. The retractable antenna of claim 1 wherein said portable communications device comprises a radio receiver.

8. The retractable antenna of claim 7 wherein said second metal connector element includes a recessed portion formed therein which receives a portion of said fingers to permit said switch to move to its normally open position when said elongated radiator is in its said extended position.

9. The retractable antenna of claim 1 wherein said switch comprises at least a pair of elongated fingers having one end secured to said first metal connector and extending upwardly therefrom into said helical radiating element so that the other end of each of said fingers is positioned within said helical radiating element, said other ends of said fingers being spaced from said helical radiating element when said elongated radiator is in its said extended position; said other ends of said fingers being in electrical contact with said helical radiating element when said elongated radiator is moved downwardly from its said extended position.

10. A retractable antenna for a communication device including a first housing having a receptacle at the upper end thereof which is RF coupled to the circuitry of the device, comprising:

an elongated radiator movable between extended and retracted positions with respect to said first housing;

a helical radiator fixed into position with respect to said first housing so that said helical radiator remains in its said fixed position regardless of whether said elongated radiator is in its extended or retracted positions;

said helical radiator being RF operatively coupled to said receptacle when said elongated radiator is in its said retracted position;

said helical radiator being RF de-coupled from said receptacle when said elongated radiator is in its said extended position;

said helical radiator being operatively RF coupled to said receptacle when said elongated radiator is in transition between its extended and retracted positions.

11. The retractable antenna of claim 10 wherein one of said radiators is always in-circuit as said elongated radiator is being moved from its retracted to extended positions and is being moved from its extended to retracted positions.

12. A retractable antenna for a communication device including a first housing having a receptacle at the upper end thereof comprising:

a first metal connector element for connection to said receptacle and having an elongated bore extending therethrough, said first metal connector element having upper and lower ends;

means for RF connecting said first metal connector to the circuitry of the communication device;

a second housing, said second housing being hollow and elongated and having upper and lower ends;

said lower end of said second housing embracing the upper end of said first metal connector;

said second housing having an opening formed in its upper end;

said second housing being comprised of a dielectric material;

a first helical radiating element in said second housing and having upper and lower ends;

a first electrical contact in said second housing and being electrically connected to the lower end of said helical radiating element;

a second contact in said second housing;

said second contact being in electrical contact with said first metal connector element;

an elongated radiator having upper and lower ends;

a second metal connector element secured to the lower end of said elongated radiator;

a dielectric body member enclosing said elongated radiator above said second metal connector element and having an upper end portion which extends upwardly beyond the upper end of said elongated radiator;

said opening in said upper end of said second housing slidably receiving said dielectric body member;

said elongated bore in said first metal connector element adapted to slidably receive said second metal connector element and said dielectric body member;

said elongated radiator being movable, with respect to said first housing and said receptacle therein, from a retracted position to an extended position;

said second metal connector element being in operative electrical contact with said first metal connector when said elongated radiator is in its extended position;

a third contact on the upper end portion of said dielectric body member;

said upper end portion of said dielectric body member being positioned within said helical radiator, to electrically isolate said elongated radiator from said helical radiator when said elongated radiator is in its said retracted position;

said helical radiator being electrically connected to said first metal connector element through said first contact, said third contact and said second contact when said elongated radiator is in its said retracted position.

* * * * *